US006550625B2

(12) United States Patent
Sundberg et al.

(10) Patent No.: US 6,550,625 B2
(45) Date of Patent: Apr. 22, 2003

(54) BOOM ARRANGEMENT FOR WORK MACHINE

(75) Inventors: Tom Sundberg, Märynummi (FI); Ismo Inkinen, Salo (FI)

(73) Assignee: Loglift Oy AB, Salo (FI)

( * ) Notice: Subject to any disclaimer, the term of this patent is extended or adjusted under 35 U.S.C. 154(b) by 0 days.

(21) Appl. No.: 09/834,982

(22) Filed: Apr. 13, 2001

(65) Prior Publication Data

US 2002/0060199 A1 May 23, 2002

(30) Foreign Application Priority Data

Apr. 26, 2000 (FI) ..... 20000978

(51) Int. Cl.[7] ..... B66C 23/42
(52) U.S. Cl. ..... 212/300; 212/238; 212/261
(58) Field of Search ..... 212/300, 238, 212/261, 256; 414/917

(56) References Cited

U.S. PATENT DOCUMENTS

| | | | | |
|---|---|---|---|---|
| 3,690,494 A | * | 9/1972 | Shepherd | 214/774 |
| 3,708,000 A | * | 1/1973 | Duffty et al. | 144/3 D |
| 3,774,659 A | * | 11/1973 | Bodine | 144/34 R |
| 4,127,152 A | * | 11/1978 | Larson et al. | 144/3 D |
| 4,583,907 A | * | 4/1986 | Wimberley | 414/718 |
| 6,079,577 A | | 6/2000 | Heikkilä | |
| 6,193,087 B1 | * | 2/2001 | Gunnarsson et al. | 212/300 |

FOREIGN PATENT DOCUMENTS

| | | |
|---|---|---|
| FI | 101785 | 5/1990 |
| FI | 961846 | 4/1996 |
| SE | 7411568 | 4/1976 |
| SE | 7411568-4 | 4/1976 |
| SE | 9201842 | 12/1993 |
| WO | 9701269 | 1/1997 |

* cited by examiner

*Primary Examiner*—Thomas J. Brahan
(74) *Attorney, Agent, or Firm*—Ladas & Parry

(57) ABSTRACT

A boom arrangement for moving a work head, which boom arrangement comprises a pillar mounted on a bearing around the vertical axis in a rotating manner, with mounting and rotational members; a lifting boom; a transfer boom; a lifting cylinder arranged between the pillar and the lifting boom; an intermediate lever mounted on the lifting boom; a tow bar, a transfer cylinder arranged between the lifting boom and the tow bar; an intermediate arm; and an arm. The lifting cylinder is mounted by the end on the side of the lifting boom on the intermediate lever, which is mounted on a bearing on the lifting boom in the zone between the end on the side of the lifting boom pillar and the middle of the lifting boom. The tow bar is mounted on one end of the intermediate lever. The arm is mounted on the tow bar by its one end and on the transfer boom by its other end. To achieve a simple and, as regards the operation, safe boom arrangement the lifting cylinder is positioned substantially below the lifting boom as a pushing cylinder, whereby the lifting of the work head is arranged to take place by increasing the length of the lifting cylinder. To achieve optimal courses of movement, the transfer cylinder is mounted on the tow bar in the vicinity of its end facing away from the intermediate lever at the pivot, which is positioned substantially apart from the straight line formed between the pivots of the tow bar ends.

6 Claims, 2 Drawing Sheets

BOOM ARRANGEMENT FOR WORK MACHINE

BACKGROUND OF THE INVENTION

The invention relates to a boom arrangement for moving a multi-function part of a work head, particularly a log loader harvester, which boom arrangement comprises a pillar mounted on a bearing around the vertical axis in a rotating manner, with mounting and rotational members; a lifting boom; a transfer boom; a lifting cylinder arranged between the pillar and the lifting boom; an intermediate lever mounted on the lifting boom; a tow bar, a transfer cylinder arranged between the lifting boom and the tow bar; an intermediate arm; and an arm.

Boom arrangements of the above-mentioned type are nowadays rather known apparatus. Log loaders for log loader harvesters used previously are most frequently what are called parallel loaders, the mechanism of which allows the work head to be moved horizontally by controlling only one actuator. The work head can be for example any wood handling apparatus, such as a cutting head, tree felling head, log collection grapple or some other apparatus.

Examples of the above solutions include the apparatus disclosed in SE patent publication 7411568-4 and Fl patent application 961846.

What the apparatus disclosed in the above publications have in common is that the lifting cylinder is not mounted directly between the pillar and the lifting boom but between the pillar and the lever pivoted in the zone between the root and middle of the lifting boom. The lever then transmits the force of the lifting cylinder further to the boom arrangement. A transfer cylinder is also mounted on said lever, the above-mentioned nearly horizontal parallel movement being achieved by means of this transfer cylinder.

In cranes L 170 V, L 200 V of the Loglift type, the lifting cylinder is positioned above and behind the pillar in an oblique position. The lever is preferably mounted on a bearing at the same pivot as the root of the lifting boom. A weakness of the structure is the relatively great height, which reduces the visual field of the driver. Also, it is difficult to make the lifting cylinder long enough, whereby either the working range of the crane at elevation is limited, or the transportation height of the crane is too great. Further, a weakness of the structural solution is that there is tension load in the lifting cylinder during the operation. The cylinder must therefore be designed in such a way that its volume becomes large and expensive. The oil on the side of the piston rod of the cylinder is continuously under high pressure, and the sealing solutions of both the piston and the piston rod must be of high quality. When the crane is in operation, the oil filling must be controlled all the time on the non-pressure side of the piston. The hydraulics of the structure is not the best possible.

In the crane according to Fl patent application 961846, part of the weaknesses of the above-mentioned solution have been successfully eliminated. Positioning the lifting cylinder upon the lifting boom in a nearly horizontal position reduces the height of the pillar and improves the visual field in the working range. Also, the solution allows the length of the lifting cylinder to be selected great enough as regards the correct working geometry and transportation height. Still, drawbacks of the solution include the tension load of the lifting cylinder and the problem points of the hydraulic system. Further, positioning the lifting cylinder behind the pillar makes it difficult to position the crane sufficiently close to the cabin of the work machine.

SUMMARY OF THE INVENTION

The lifting cylinder positioned above the lifting boom can also form a risk factor. The lifting cylinder is subjected to great fatigable tension load during the operation. Thus, some load-bearing structure in the cylinder can fail. Such failure points can include for example the loop of the cylinder liner, the loop of the piston rod and the wire-wraps between the parts. Not only do the work machine and the whole boom arrangement fall to the ground as a result of the fatigue failure, but the lifting cylinder may also move suddenly when it breaks down. If, for example, the loop of the piston rod fails for some reason, the cylinder may bounce backwards and turn, resting on the mounting of its one end, i.e. the end on the side of the pillar. The turning continues backwards until the cylinder hits an obstacle. There is often the cabin of the work machine behind the crane. It is easy to understand that when designed or manufactured defectively, the structure forms a safety risk.

An object of the invention is to provide a boom arrangement by means of which drawbacks of the prior art can be eliminated. This is achieved by means of the boom arrangement according to the invention. The boom arrangement according to the invention is characterized in that the lifting cylinder is positioned substantially below the lifting boom and between the pillar and the intermediate lever as a pushing cylinder, whereby the lifting of the work head is arranged to take place by increasing the length of the lifting cylinder, the tow bar is pivoted at the intermediate lever, at its end facing away from the lifting cylinder, and the transfer cylinder is mounted on the tow bar close to the tow bar end facing away from the intermediate lever, at a pivot positioned substantially apart from the straight line between the pivots a, b of the tow bar ends.

An advantage of the invention is that the boom arrangement can be made small in size and sufficient in length without problems with the transportation height, limited working range or safety. The performance of the hydraulic system is also better than in known solutions, because the volume of the non-pressure oil on the side of the piston rod of the cylinder is small. An advantage of the invention is further that the solution can utilize components of existing cranes manufactured for the loading use of timber. For example, the pillar and the lifting cylinder can be selected directly from a loading crane. This advantage is significant for a machine entrepreneur whose machine selection includes both harvester cranes according to the invention and above-mentioned loading cranes. The lifting cylinder is easy to protect against outside impact by means of a light and preferred structure. Positioning the lifting cylinder on the front side of the boom arrangement allows the crane to be positioned very close to the cabin and rear axle of the work machine, which improves the stability of the work machine. During the operation, the lifting boom must sometimes be lifted in a completely vertical position. In the invention this, too, can take place in a preferred manner. Not only is the stability improved but the rear axle weight and transportation length of the work machine are also reduced compared with the prior art. Hereby, the work machine can move in a more preferred manner than previously both on roads and off-road.

BRIEF DESCRIPTION OF THE DRAWINGS

The invention will now be described in more detail by means of a preferred embodiment illustrated in the attached drawings, whereby.

DETAILED DESCRIPTION

Figure 1:
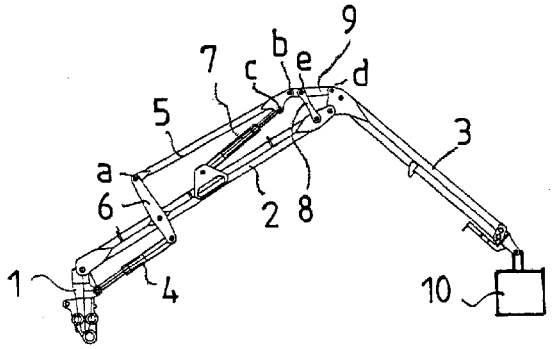
FIG. 1 shows a principled side view of a boom arrangement according to the invention.

FIG. 1 shows a principled view of a boom arrangement according to the invention. The boom arrangement comprises a pillar 1 mounted on a bearing around the vertical axis in a rotating manner, with mounting and rotational members, a lifting boom 2, and a transfer boom arrangement 3. A lifting cylinder 4 is arranged between the pillar and the lifting boom. An intermediate lever 6 is mounted on the lifting boom 2. The boom arrangement further comprises a tow bar 5, a transfer cylinder 7 arranged between the lifting boom and the tow bar, an intermediate arm 8, and an arm 9.

The lifting cylinder 4 is mounted by the end on the side of the lifting boom 2 on the intermediate lever 6, which is mounted on a bearing on the lifting boom 2 somewhere in the zone between the lifting boom ends joined to the pillar 1 and the transfer boom arrangement 3. The tow bar 5 is mounted on one end of the intermediate lever 6. The arm 9, in turn, is mounted on the tow bar 5 by one end, and on the transfer boom arrangement 3 by the other end. The intermediate arm 8 is mounted by its one end in the vicinity of the end on the side of the transfer boom arrangement of the lifting boom 2, and by its other end on the arm 9, at a pivot e in the zone between the arm ends b, d.

The boom arrangement according to the invention is intended for moving a work head. A practical example is a boom arrangement enabling the movement of the multi-function part of a log loader harvester. The work head can in practice be any wood handling apparatus, such as a cutting head, tree felling head, log collection grapple or some other apparatus, such as a coppice clearing apparatus. The work head is shown in principle in FIG. 1 by reference numeral 10.

Figure 2:
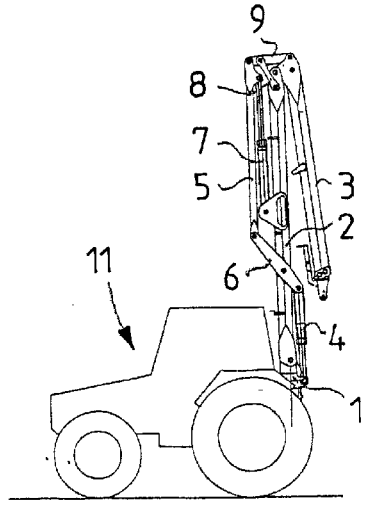
FIG. 2 shows a boom arrangement according to the invention in the working position in the near zone.
Figure 3:
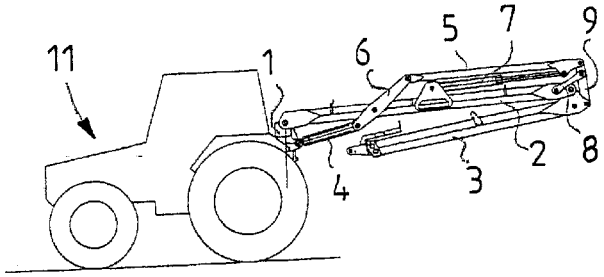
FIG. 3 shows a boom arrangement according to the invention in the transportation position.
Figure 4:
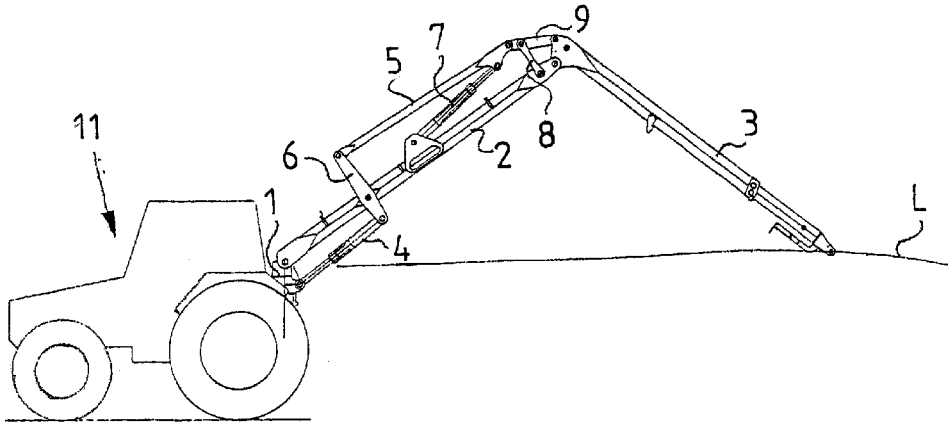
FIG. 4 shows the course of movement of the tip of the boom of a boom arrangement according to the invention, for example when the boom arrangement is transferred from an outstretched position to a retracted position.
Figure 5:
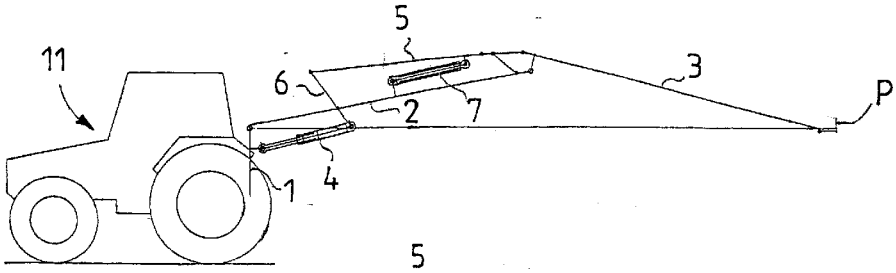
FIGS. 5 to 10 show a principled view of the situation of FIG. 4, step by step from the beginning of the movement to the end of it.
Figure 6:
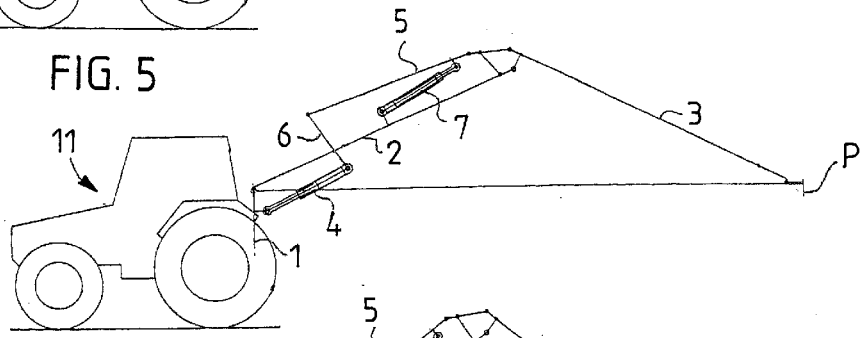
Figure 7:
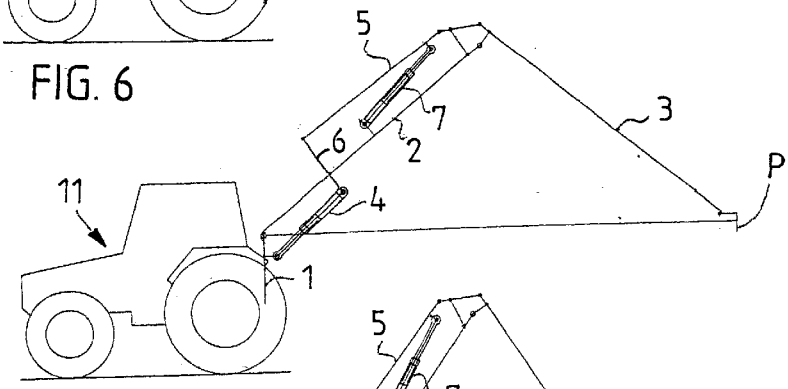
Figure 8:
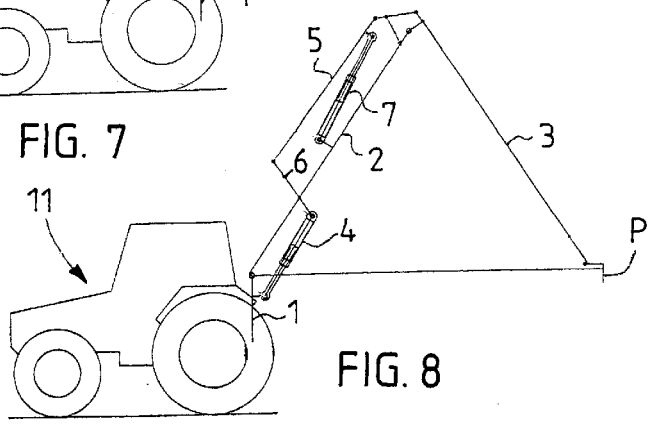
Figure 9:
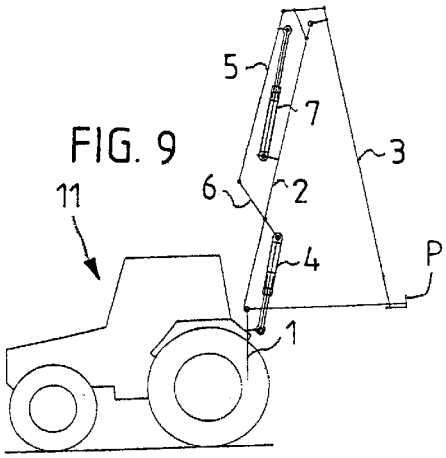
Figure 10:
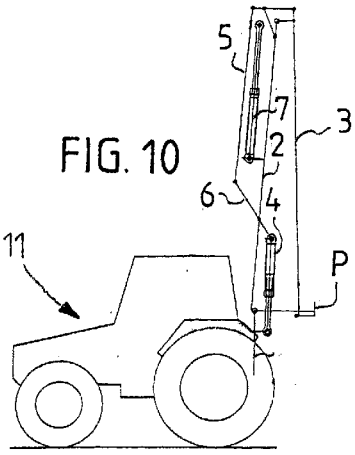

The log loader according to the invention can be mounted on the work machine for example in the way shown in FIGS. 2 to 4. The work machine is indicated by reference numeral 11.

According to the essential idea of the invention, the lifting cylinder 4 is positioned substantially below the lifting boom 2 as a pushing cylinder, whereby the lifting of the work head is arranged to take place by increasing the length of the lifting cylinder 4. The transfer cylinder 7, in turn, is mounted on the tow bar 5 in the vicinity of the tow bar end facing away from the intermediate lever at a pivot c, which is positioned substantially apart from the straight line formed by the pivots a, b of the ends of the tow bar 5.

FIGS. 2 to 4 show the boom arrangement according to the invention in different positions. FIG. 2 shows the boom arrangement in the working position in the near zone, where by the boom is in a vertical position. In FIG. 3, the boom arrangement is in the transportation position. FIG. 4 shows a situation where the boom arrangement is in a position in which the work head is relatively far away from the work machine. Line L in the figure indicates the course of movement of the tip of the boom when the boom arrangement is being moved into the position according to FIG. 2. As can be seen from FIG. 4, the course of movement of the boom tip is substantially horizontal.

The above-mentioned course of movement of the boom tip is shown step by step in FIGS. 5 to 10. In FIGS. 5 to 10, corresponding points have the same reference numerals as in FIGS. 1 to 4. In the first figure of the figure series 5 to 10, the boom arrangement is outstretched into a substantially horizontal position. The figure series indicates how the boom arrangement moves by running one cylinder only, i.e. the transfer cylinder 7. The tip of the extension moves along an ideal, nearly horizontal line, whereby the control of the boom arrangement and the work head at the end can be performed easily and quickly. The deviation of the tip from the horizontal line is shown in FIGS. 5 to 10 by means of arrow P denoted beside the tip. As little energy as possible is consumed, because oil does not have to be transferred from one cylinder to another. The transfer cylinder 7 is positioned in a protected location between the draw bar 5 transmitting traction power and the lifting boom 2. One end of the transfer cylinder is mounted on the lifting boom 2, in the case of the figures close to the middle of the boom. The other end of the transfer cylinder 7 is preferably pivoted at the axle c of its own below the straight line formed by the pivots a, b of the ends of the draw bar 5. In the example of the figures, the pivot c is positioned in the zone of that end of the tow bar 5 which faces away from the intermediate lever 6. Thus, a very simple structure has been achieved for the tow bar 5, and it has become possible to select the torque generated by the transfer cylinder 7 to the transfer boom 3 such that it is preferable for the work.

The example shown in the figures is by no means intended to limit the invention but the invention can be modified totally freely within the scope of the claims. Thus, it is obvious that the boom arrangement according to the invention or the details thereof do not have to be exactly as shown in the figures but that other solutions are also feasible.

What is claimed is:

1. A boom arrangement for moving a work head comprising:

a pillar supported for rotational movement around a vertical axis, a lifting boom pivotably connected to said pillar, a transfer boom having an end adapted for attachment to the work load, an intermediate lever pivotably connected to said lifting boom, a lifting cylinder having one end pivotably connected to said pillar and an opposite end pivotably connected to said intermediate lever, a tow bar pivotably connected to said intermediate lever, a transfer cylinder having one end pivotably connected to said lifting boom and an opposite end pivotably connected to the tow bar, an arm having one end pivotably connected to said transfer boom and an opposite end pivotably connected to said tow bar, an intermediate arm having one end pivotably connected to said lifting boom and an opposite end pivotably connected to said arm, said lifting cylinder being arranged below said lifting boom and acting as a pushing cylinder to produce folding of the lifting boom and the transfer boom to lift the work load, said transfer cylinder being operative to be lengthened and shortened while the lifting cylinder is inactive to displace the work head inwards towards the pillar and outwards away from the pillar, said transfer cylinder being connected to the tow bar by a pivot located below a line connecting pivots respectively connecting the tow bar to the intermediate lever and the tow bar to said arm so that when the transfer cylinder is lengthened and shortened, the work head travels inwards and outwards along a substantially horizontal line.

2. The boom arrangement of claim 1, wherein said lifting cylinder and said tow bar are connected to said intermediate lever on opposite sides thereof from the pivotable connection of the intermediate lever to said lifting boom.

3. The boom arrangement of claim 1, wherein said transfer cylinder extends diagonally between said lifting boom and said tow bar when the transfer boom and the lifting boom are unfolded.

4. The boom arrangement of claim 1, wherein said transfer cylinder is pivotably connected to said tow bar by a pivot fixed to said tow bar at an underside of said tow bar.

5. The boom arrangement of claim 4, wherein said transfer cylinder is pivotably connected to said lifting boom by a pivot fixed to said lifting boom at a level above the lifting boom.

6. The boom arrangement of claim 4, wherein said pivot which connects the transfer cylinder to the tow bar is located in proximity to the pivot connecting the tow bar to said arm.

* * * * *